US012344452B2

(12) United States Patent
Nemoto

(10) Patent No.: US 12,344,452 B2
(45) Date of Patent: Jul. 1, 2025

(54) PACKING MEMBER

(71) Applicant: KYOCERA Document Solutions Inc., Osaka (JP)

(72) Inventor: Shinji Nemoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 18/634,468

(22) Filed: Apr. 12, 2024

(65) Prior Publication Data

US 2024/0351769 A1 Oct. 24, 2024

(30) Foreign Application Priority Data

Apr. 20, 2023 (JP) ..... 2023-069215

(51) Int. Cl.
*B65D 81/113* (2006.01)

(52) U.S. Cl.
CPC ..... *B65D 81/113* (2013.01); *B65D 2585/689* (2013.01)

(58) Field of Classification Search
CPC .. B65D 81/113; B65D 81/127; B65D 81/053; B65D 81/054; B65D 81/055; B65D 81/056; B65D 81/057; B65D 81/058; B65D 2585/689
USPC ..... 206/320, 586, 591, 592, 594
See application file for complete search history.

(56) References Cited

U.S. PATENT DOCUMENTS

2010/0187149 A1* 7/2010 Tsukii ..... B65D 5/5035 493/405
2016/0362222 A1* 12/2016 Takeuchi ..... B65D 19/0095
2019/0352073 A1* 11/2019 Ikeda ..... G03G 21/16
2020/0231358 A1* 7/2020 Hashimoto ..... B31D 5/0073
2023/0146687 A1* 5/2023 Nemoto ..... B65D 81/025 206/521

FOREIGN PATENT DOCUMENTS

JP 2000-327037 A 11/2000

* cited by examiner

*Primary Examiner* — Jacob K Ackun
(74) *Attorney, Agent, or Firm* — Stein IP, LLC

(57) ABSTRACT

A packing member includes a packing case, a first cushioning member that includes a side plate and a second cushioning member that is arranged between the side plate and the packing case, the first cushioning member includes a first engagement portion, the first engagement portion is coupled to an upper edge of the side plate, the second cushioning member includes a second engagement portion, the first cushioning member and the second cushioning member are stored in the packing case, and the first engagement portion and the second engagement portion are engaged with each other by turning the first engagement portion downward such that the first cushioning member is located and the first engagement portion is turned upward such that the engagement of the first engagement portion and the second engagement portion is released.

6 Claims, 13 Drawing Sheets

PACKING MEMBER

INCORPORATION BY REFERENCE

This application is based upon and claims the benefit of priority from the corresponding Japanese Patent Application No. 2023-069215 (filed on Apr. 20, 2023), the entire contents of which are incorporated herein by reference.

BACKGROUND

The present disclosure relates to packing members.

Conventionally, a packing member is known which includes a cushioning member for cushioning an impact applied to an item to be packed that is stored in a packing case.

SUMMARY

A packing member according to an aspect of the present disclosure includes a packing case, a first cushioning member and a second cushioning member. The packing case includes an opening in an upper portion, and an item to be packed is removed from and inserted into the packing case via the opening. The first cushioning member includes a side plate which is arranged opposite the item to be packed in a first direction. The second cushioning member is arranged between the side plate and the packing case. The first cushioning member includes a first engagement portion. The first engagement portion is coupled to an upper edge of the side plate and is bent at a part coupled to the side plate such that a tip on a side opposite to a side coupled to the side plate can be turned vertically with the coupled part used as a fulcrum. The second cushioning member includes a second engagement portion that can be engaged with the first engagement portion. The first cushioning member and the second cushioning member are stored in the packing case, and the first engagement portion and the second engagement portion are engaged with each other by turning the first engagement portion downward such that the first cushioning member is located with respect to the second cushioning member. The first engagement portion is turned upward in a state where the first engagement portion and the second engagement portion are engaged with each other such that the engagement of the first engagement portion and the second engagement portion is released.

Figure 9:
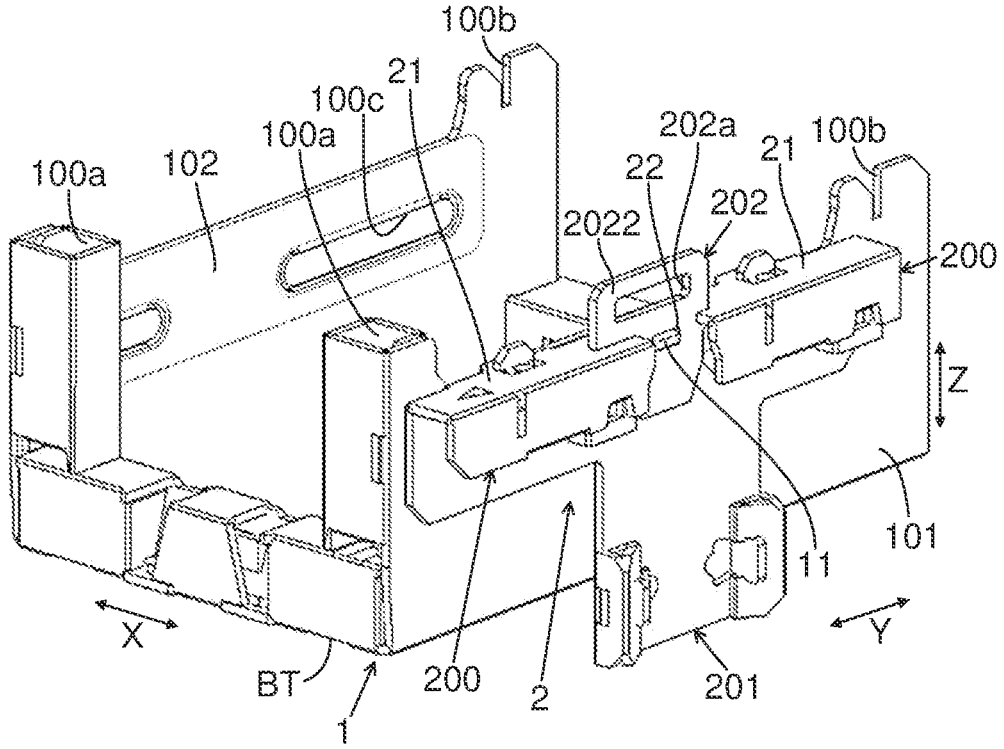
Figure 10:
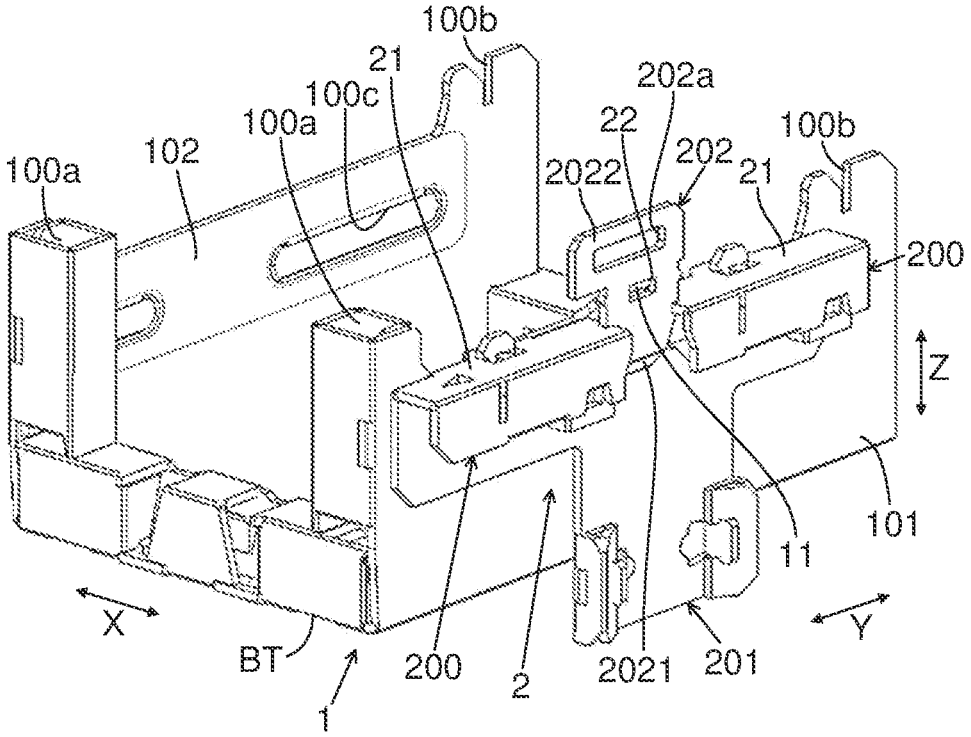
Figure 11:
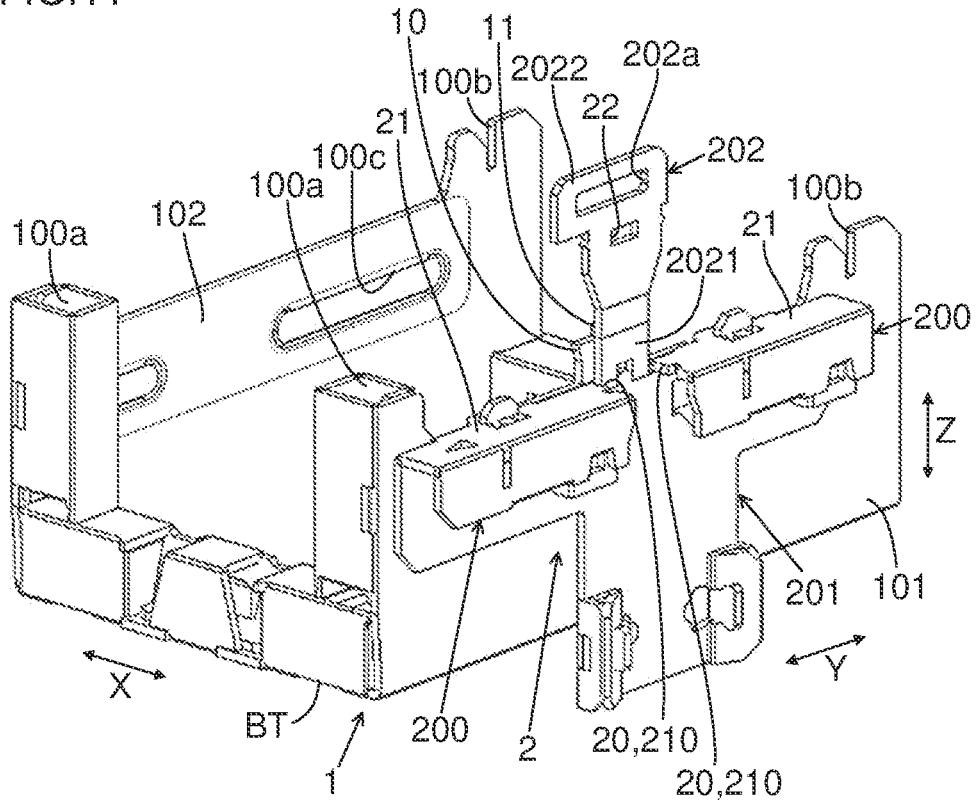
Figure 12:
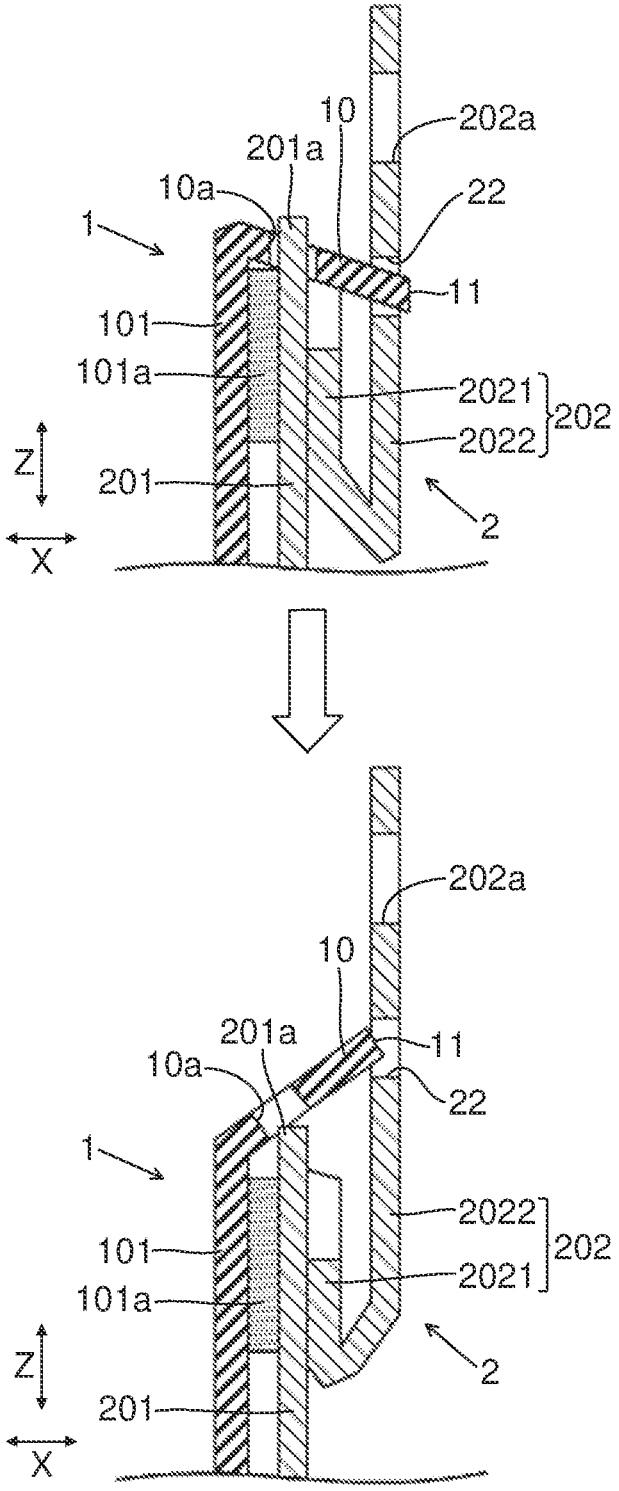
Figure 13:
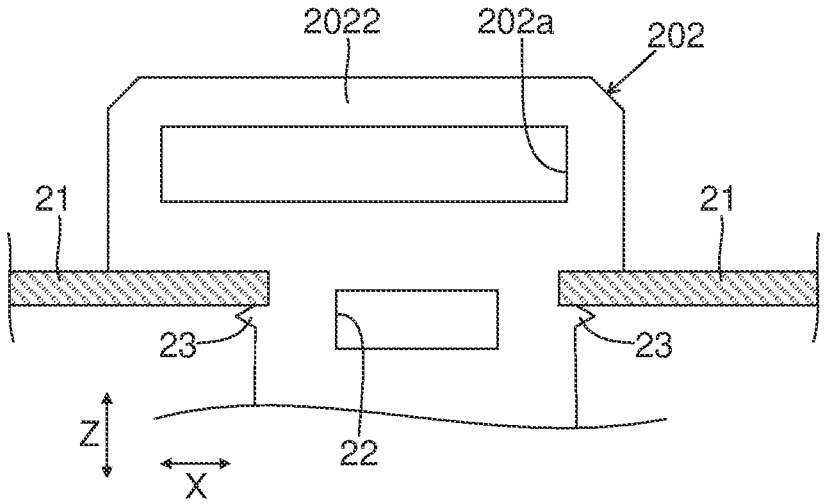

A schematic view showing the widths of an impact dispersion plate and the cushioning member;

FIG. 9 is a perspective view showing a state where the first cushioning member and the second cushioning member in the embodiment are completely coupled to each other;

FIG. 10 is a perspective view showing a state where the first cushioning member and the second cushioning member in the embodiment are being removed;

FIG. 11 is a perspective view showing a state where the coupling of the first cushioning member and the second cushioning member in the embodiment is released;

FIG. 12 is a schematic view showing a positional relationship between the engagement protrusion of the first engagement portion and the engagement hole of a second grasping portion in the embodiment; and FIG. 13 is a diagram showing a state where a pair of locking pieces of the second grasping portion in the embodiment are engaged with a pair of plate-shaped parts.

DETAILED DESCRIPTION

A packing member 1000 according to an embodiment of the present disclosure will be described below with reference to FIGS. 1 to 13.

In the following description, an X direction shown in the figures is defined as a left/right direction. One side in the X direction is the right side, and the other side in the X direction is the left side. The X direction corresponds to a "first direction". In the following description, a Y direction shown in the figures (that is, a direction orthogonal to the X direction) is defined as a forward/backward direction. One side in the Y direction is the front side, and the other side in the Y direction is the back side. The Y direction corresponds to a "second direction". A Z direction shown in the figures (that is, a direction orthogonal to the X direction and the Y direction) is an up/down direction.

In the following description, an outward side in the X direction (corresponding to an "outward side in the first direction") is a direction away from the center of a packing case PB in the X direction toward one side or the other side in the X direction, and an inward side in the X direction (corresponding to an "inward side in the first direction") is a direction approaching the center of the packing case PB in the X direction from one side or the other side in the X direction. An outward side in the Y direction (corresponding to an "outward side in the second direction") is a direction away from the center of the packing case PB in the Y direction toward one side or the other side in the Y direction, and an inward side in the Y direction (corresponding to an "inward side in the second direction") is a direction approaching the center of the packing case PB in the Y direction from one side or the other side in the Y direction. In other words, The "outward side" is a direction which extends outward from the inside of the packing case PB, and the "inward side" is a direction which extends inward from the outside of the packing case PB.

<Overall Configuration>

As shown in FIGS. 1 to 5, the packing member 1000 of the present embodiment includes a first cushioning member 1, a second cushioning member 2, a cushioning member set 3 and the packing case PB.

The packing case PB includes an opening OP in an upper portion. An item to be packed PA is removed from and inserted into the packing case PB via the opening OP.

The first cushioning member 1 is formed by bending a single cardboard sheet. The first cushioning member 1 includes a bottom plate BT. The item to be packed PA is placed on the bottom plate BT. The first cushioning member 1 also includes a right side plate 101 and a left side plate 102. The right side plate 101 corresponds to a "side plate".

The right side plate 101 is formed by bending upward a right side part of the bottom plate BT of the cardboard sheet serving as the first cushioning member 1, and the left side plate 102 is formed by bending upward a left side part of the bottom plate BT of the cardboard sheet serving as the first cushioning member 1. In other words, the right side plate 101 is coupled to a right side edge of the bottom plate BT, and the left side plate 102 is coupled to a left side edge of the bottom plate BT.

Each of the right side plate 101 and the left side plate 102 includes a tube portion 100*a* on the front side. In a state where the first cushioning member 1 is arranged inside the packing case PB, the tube axis direction thereof is the up/down direction. In other words, each of the right side plate 101 and the left side plate 102 includes an opening which is directed upward. The tube portion 100*a* functions as a cushioning material which cushions an impact applied to the item to be packed PA from the front side of the packing case PB. Furthermore, the tube portion 100*a* is used to support a front cushioning member 33 which will be described later.

Each of the right side plate 101 and the left side plate 102 includes a slit 100*b* which is cut downward from above. The slit 100*b* is used to support a back cushioning member 34 which will be described later.

Each of the right side plate 101 and the left side plate 102 is arranged opposite the item to be packed PA in the left/right direction. The right side plate 101 is arranged on the right side of the item to be packed PA, and the left side plate 102 is arranged on the left side of the item to be packed PA. In this way, the right side plate 101 and the left side plate 102 sandwich the item to be packed PA in the left/right direction.

Each of the right side plate 101 and the left side plate 102 can be turned such that an end portion (here, the end portion is referred to as a turning end) on a side opposite to a side coupled to the bottom plate BT swings with the coupled part of the bottom plate BT used as a fulcrum. In a state where the item to be packed PA is placed on the bottom plate BT, the turning end of each of the right side plate 101 and the left side plate 102 is moved inward (that is, to a side toward the item to be packed PA), and thus the item to be packed PA is sandwiched between the right side plate 101 and the left side plate 102 in the left/right direction.

In an operation of removing the item to be packed PA from the packing case PB, the item to be packed PA is removed from the packing case PB together with the first cushioning member 1. In order to enhance the convenience of the operation, each of the right side plate 101 and the left side plate 102 includes a handle 100*c* which is formed with a long hole that penetrates in the direction of the thickness thereof.

When the item to be packed PA is removed from the packing case PB together with the first cushioning member 1, the turning end of each of the right side plate 101 and the left side plate 102 can be moved outward (that is, to a side away from the item to be packed PA). In this way, the item to be packed PA is easily removed from the first cushioning member 1.

The second cushioning member 2 is arranged on the right side of the item to be packed PA. The second cushioning member 2 cushions an impact which is applied to the item to be packed PA from the right side of the packing case PB. The details thereof will be described later.

The cushioning member set 3 includes lower cushioning members 31 and 32, the front cushioning member 33, the back cushioning member 34 and upper cushioning members 35 and 36. These cushioning members 31 to 36 surround the item to be packed PA inside the packing case PB to cushion an impact which is applied to the item to be packed PA from the outside of the packing case PB.

The lower cushioning members 31 and 32 are respectively arranged at a lower right corner portion and a lower left corner portion of the item to be packed PA. The lower cushioning members 31 and 32 are formed of a pulp mold material using a mold by a pulp mold molding method.

In an operation of storing the item to be packed PA in the packing case PB, the lower cushioning members 31 and 32 are first stored in the packing case PB. The lower cushioning member 31 is arranged at a lower right corner portion inside the packing case PB, and the lower cushioning member 32 is arranged at a lower left corner portion inside the packing case PB. Thereafter, the item to be packed PA is stored in the packing case PB together with the first cushioning member 1. In this way, the lower right corner portion and the lower left corner portion of the item to be packed PA are stored in the lower cushioning members 31 and 32, respectively.

The front cushioning member 33 is arranged on the front side of the item to be packed PA. The back cushioning member 34 is arranged on the back side of the item to be packed PA. The front cushioning member 33 and the back cushioning member 34 are formed by bending a single cardboard sheet. The front cushioning member 33 and the back cushioning member 34 are supported by the first cushioning member 1.

The front cushioning member 33 includes a tube portion (reference sign is omitted) in which the up/down direction is the tube axis direction thereof. The tube portion is inserted into the tube portion 100*a* of the first cushioning member 1, and thus the front cushioning member 33 is supported by the first cushioning member 1.

The back cushioning member 34 includes a slit (reference sign is omitted) which is cut upward from below. The slit is inserted into the slit 100*b* of the first cushioning member 1, and thus the back cushioning member 34 is supported by the first cushioning member 1.

The item to be packed PA is stored in the packing case PB together with the first cushioning member 1, and thereafter the tube portion of the front cushioning member 33 is inserted into the tube portion 100*a* of the first cushioning member 1. The slit of the back cushioning member 34 is also inserted into the slit 100*b* of the first cushioning member 1.

The upper cushioning members 35 and 36 are respectively arranged at an upper right corner portion and an upper left corner portion of the item to be packed PA. The upper cushioning members 35 and 36 are formed of the pulp mold material using a mold by the pulp mold molding method.

Figure 6:
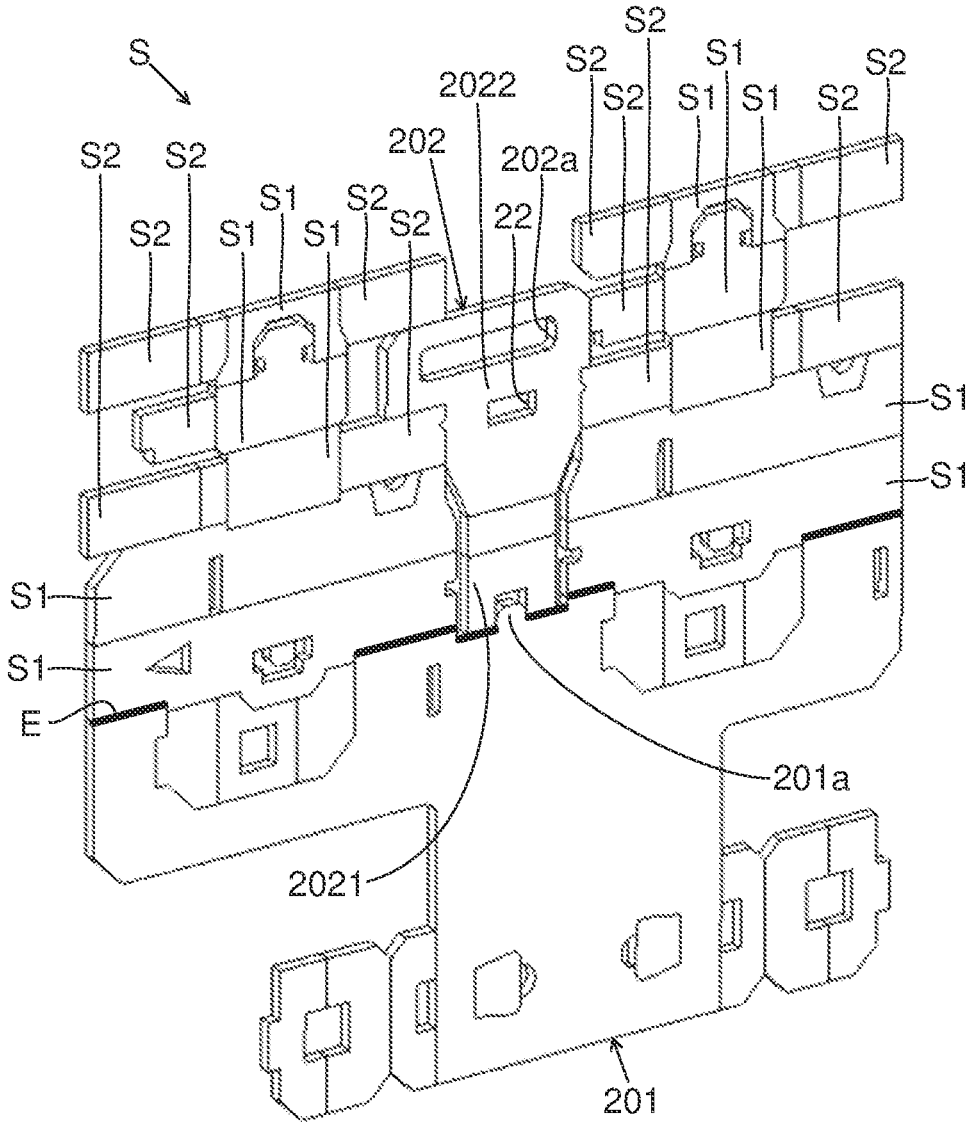
FIG. 6 is a developed perspective view of the cushioning member shown in FIG. 5.

The second cushioning member 2 is formed by bending a single cardboard sheet S (see FIG. 6). FIG. 6 shows a state where the second cushioning member 2 is developed.

The second cushioning member 2 includes a pair of cushioning portions 200. The pair of cushioning portions 200 are formed by bending the cardboard sheet S into a square tube shape. The pair of cushioning portions 200 are arranged such that the tube axis direction thereof is the forward/backward direction. The pair of cushioning portions 200 are spaced opposite each other in the forward/backward direction. Of the cardboard sheet S (see FIG. 6), parts S1 are bent into a square tube shape, and parts S2 are bent so as to be arranged inside the tube. In this way, the pair of cushioning portions 200 are coupled to the upper edge of a base plate 201 which will be described later. In FIG. 6, the parts of the upper edge of the base plate 201 are indicated by a thick line and are identified by a reference sign E.

The second cushioning member 2 cushions an impact applied to a low-strength part of the item to be packed PA whose strength is lower than the other parts. For example, the right side part of the item to be packed PA is the low-strength part. In this case, the second cushioning member 2 is arranged between the right side part of the item to be packed PA and the packing case PB in the left/right direction. In other words, the second cushioning member 2 is arranged on the right side of the item to be packed PA together with the right side plate 101 of the first cushioning member 1. The second cushioning member 2 is arranged on an outward side relative to the right side plate 101 in the left/right direction.

For example, when the strength of the left side part of the item to be packed PA is low as with the right side part (when the left side part of the item to be packed PA is also a low-strength part), the second cushioning member 2 may be arranged between the left side part of the item to be packed PA and the packing case PB in the left/right direction. However, here, it is assumed that only the right side part of the item to be packed PA is the low-strength part.

The right side plate 101 of the first cushioning member 1 includes an impact dispersion region 101*a* which is harder than the other regions of the right side plate 101. The impact dispersion region 101*a* is a region which is long in the forward/backward direction, and is opposite both the pair of cushioning portions 200 in the left/right direction. The impact dispersion region 101*a* may be formed by adhering a cardboard sheet to the right side plate 101 or may be formed by adhering a sheet member harder than a cardboard sheet to the right side plate 101.

The impact dispersion region 101*a* is provided on the right side plate 101, and thus it is possible to suppress intensive application of an impact to parts of the right side plate 101 opposite the pair of cushioning portions 200 in the left/right direction. In other words, an impact received by the pair of cushioning portions 200 can be dispersed over a wide range. In this way, it is possible to disperse an impact applied to the right side part of the item to be packed PA over a wide range.

The second cushioning member 2 includes the base plate 201. The base plate 201 is arranged such that the direction of the thickness thereof is the left/right direction. The base plate 201 is arranged opposite the right side plate 101 in the left/right direction. The base plate 201 is arranged on an outward side relative to the right side plate 101 in the left/right direction. The pair of cushioning portions 200 are bend into a square tube shape on the outward side relative to the base plate 201 in the left/right direction. In other words, the pair of cushioning portions 200 are arranged on the outward side relative to the base plate 201 in the left/right direction.

The second cushioning member 2 includes a grasping plate 202. The grasping plate 202 is coupled to the upper edge of the base plate 201. A part between a pair of parts of the upper edge of the base plate 201 in the left/right direction to which the pair of cushioning portions 200 are coupled is the coupled part of the grasping plate 202.

The grasping plate 202 is grasped by an operator. Hence, the grasping plate 202 includes a handle 202*a* in an end portion on a side opposite to a side coupled to the base plate 201. The handle 202*a* is a long hole which penetrates in the direction of the thickness of the grasping plate 202. When an operation of removing the second cushioning member 2 from the packing case PB is performed, the operator grasps the handle 202*a* to pull the grasping plate 202 upward.

The grasping plate 202 is folded in half. The grasping plate 202 is folded in half, and thus a part of the grasping plate 202 is arranged between the base plate 201 and the packing case PB in the left/right direction (that is, on the outward side relative to the base plate 201 in the left/right direction). In other words, the grasping plate 202 is folded in half, and thus the part of the grasping plate 202 is arranged below the upper edge of the base plate 201.

On the other hand, the end portion of the grasping plate 202 including the handle 202*a* protrudes upward relative to the upper edge of the base plate 201 in a state where the grasping plate 202 is folded in half. In the state where the grasping plate 202 is folded in half, the end portion of the grasping plate 202 including the handle 202*a* protrudes upward from between the pair of cushioning portions 200 in the forward/backward direction. In other words, the grasping plate 202 is folded in half to be sandwiched between the pair of cushioning portions 200 in the forward/backward direction. Although details will be described later, the grasping plate 202 is sandwiched between a pair of plate-shaped parts 21 in the forward/backward direction. In this way, even when the grasping plate 202 is folded in half, the operator can grasp the handle 202*a*.

The grasping plate 202 includes a first grasping portion 2021 and a second grasping portion 2022 (see FIG. 6 and the like). The first grasping portion 2021 is a part which is bent downward from the upper edge of the base plate 201. The second grasping portion 2022 is a part which is bent upward from an edge of the first grasping portion 2021 on a side opposite to a side coupled to the base plate 201. The grasping plate 202 is folded in half, and thus the second grasping portion 2022 is arranged on the outward side relative to the first grasping portion 2021 in the left/right direction.

<Structure for Suppressing Positional Displacement of Second Cushioning Member>

Figure 7:
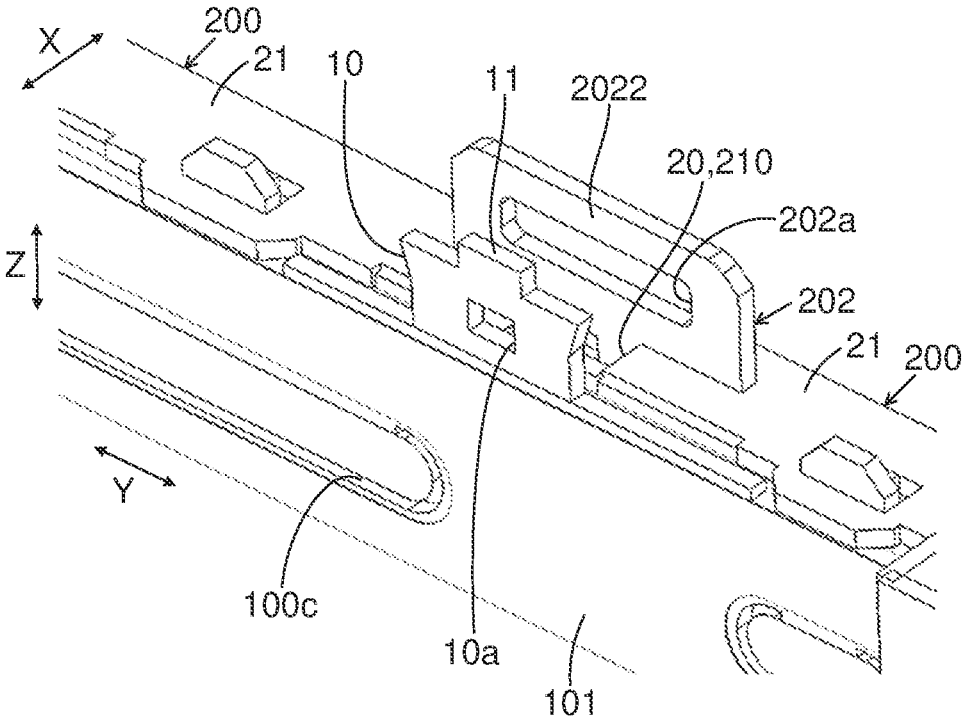
FIG. 7 is a perspective view showing a first engagement portion and a second engagement portion in the embodiment (diagram showing a state where the engagement of the first engagement portion and the second engagement portion is released)
Figure 8:
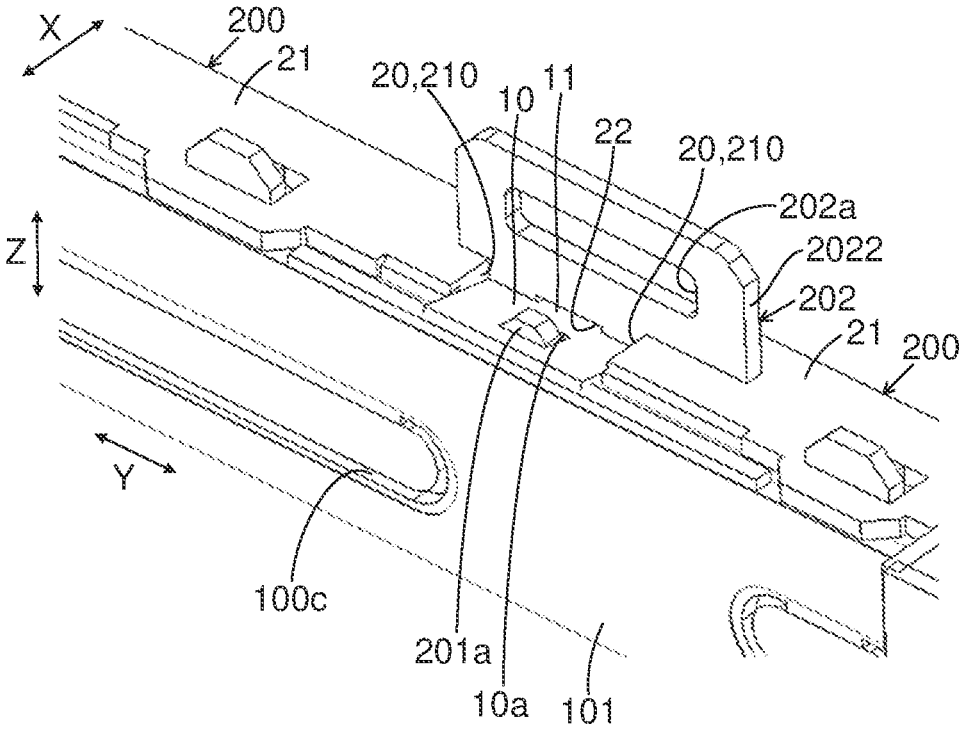
FIG. 8 is a perspective view showing the first engagement portion and the second engagement portion in the embodiment (diagram showing a state where the first engagement portion and the second engagement portion are engaged with each other)

As shown in FIGS. 7 and 8, the first cushioning member 1 and the second cushioning member 2 can be coupled to each other. The first cushioning member 1 and the second cushioning member 2 are coupled to each other, and thus the second cushioning member 2 is fixed to the first cushioning member 1. The item to be packed PA is placed on the bottom plate BT of the first cushioning member 1, and thus the first cushioning member 1 hardly moves inside the packing case PB. Hence, the second cushioning member 2 is fixed to the first cushioning member 1, and thus it is possible to suppress a positional displacement of the second cushioning member 2 inside the packing case PB. In other words, it is possible to suppress a displacement of the second cushioning member 2 from the low-strength part of the item to be packed PA.

Figure 1:
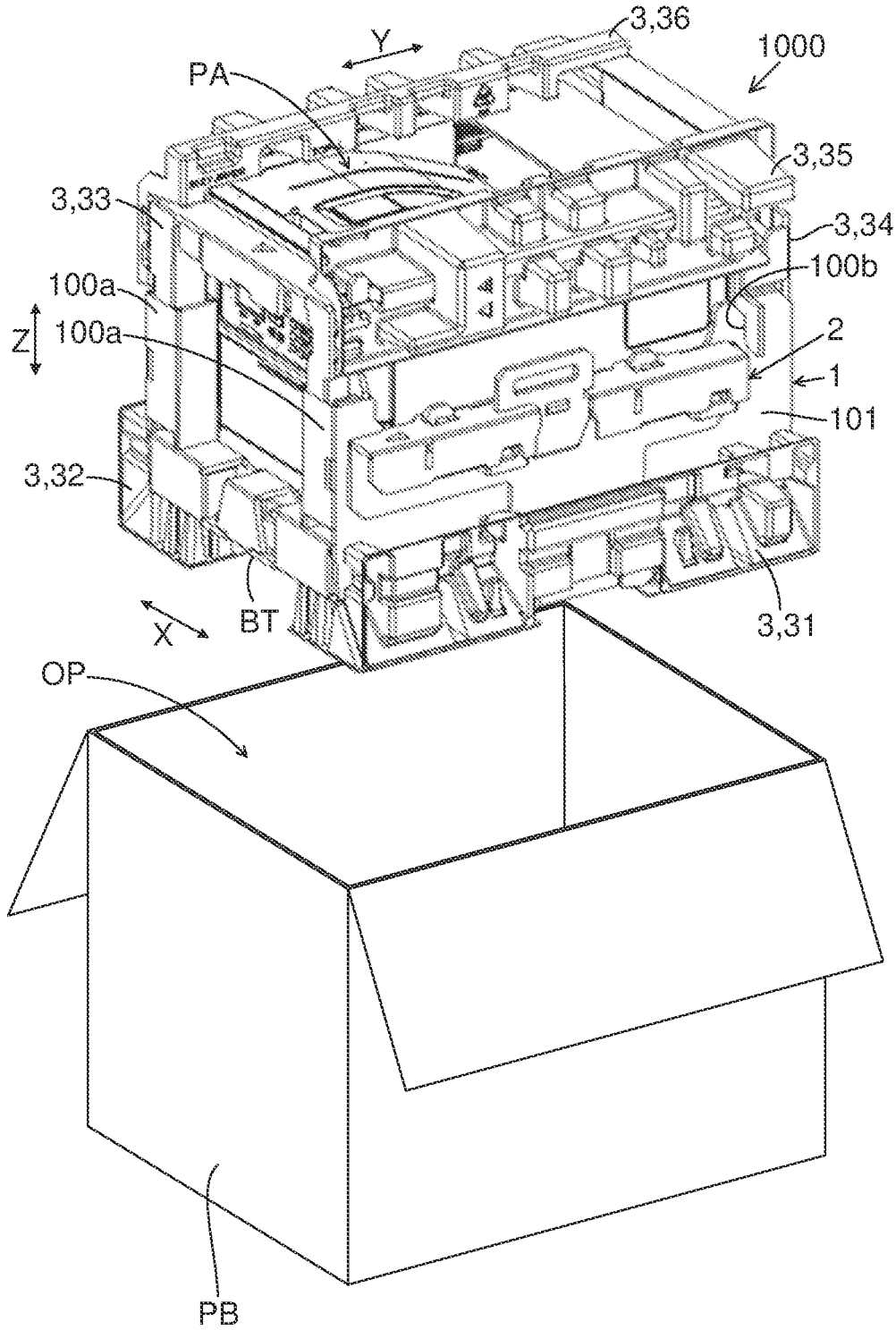
FIG. 1 is a perspective view when a packing member according to an embodiment is viewed from the right side together with an item to be packed.
Figure 2:
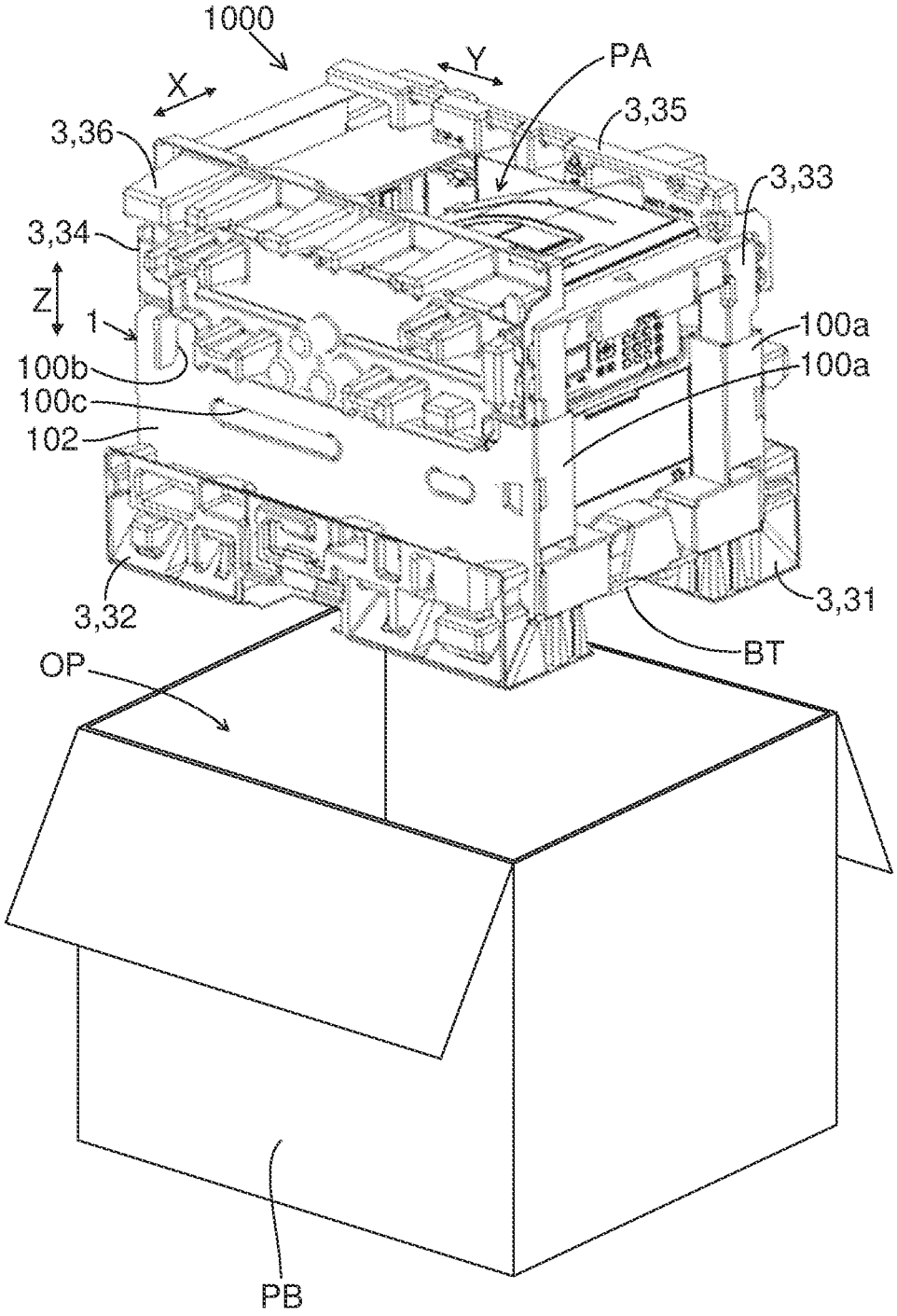
FIG. 2 is a perspective view when the packing member according to the embodiment is viewed from the left side together with the item to be packed.
Figure 3:
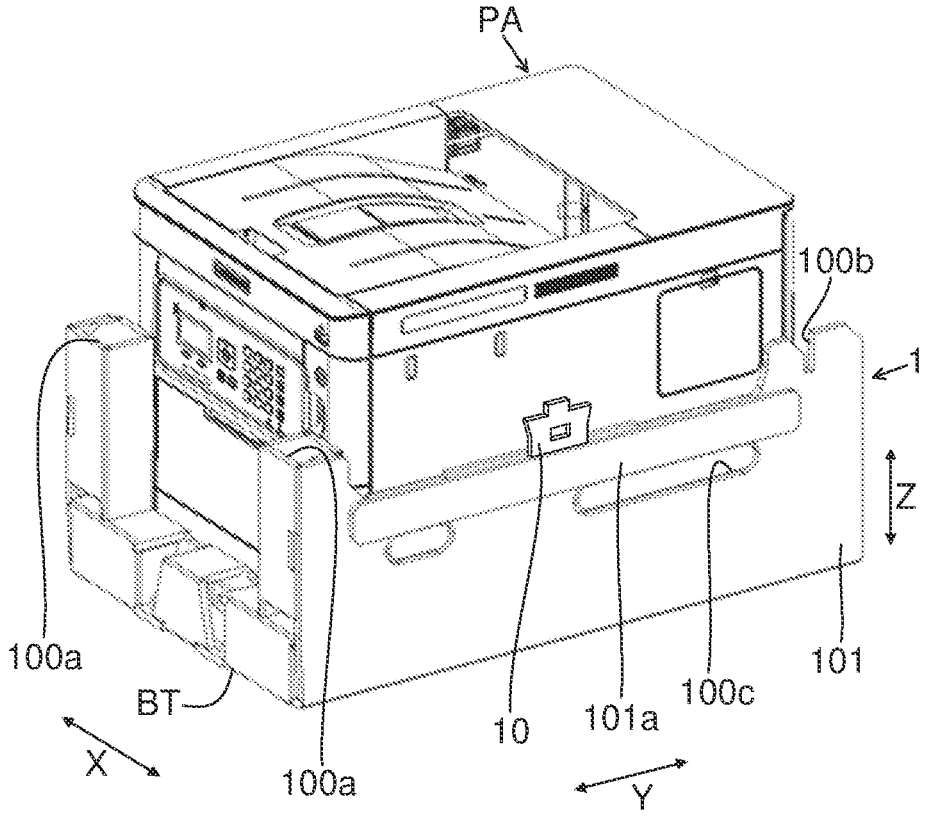
FIG. 3 is a perspective view when a first cushioning member in the embodiment is viewed from the right side together with the item to be packed.
Figure 4:
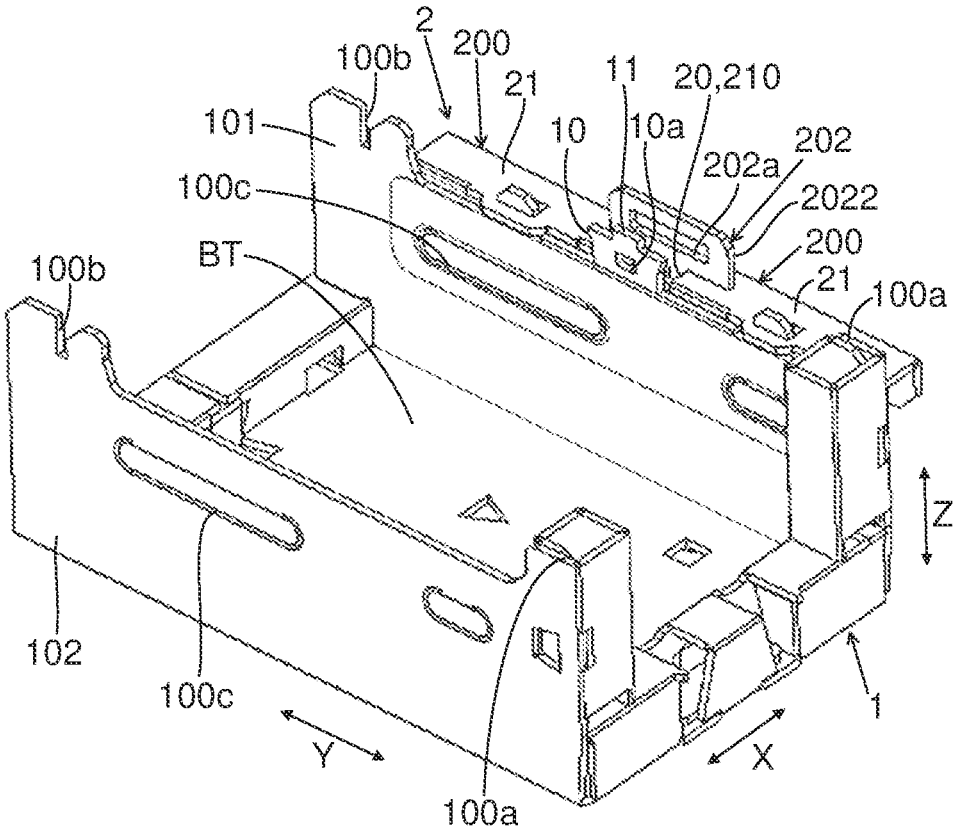
FIG. 4 is a perspective view when the first cushioning member and a second cushioning member in the embodiment are viewed from the left side.
Figure 5:
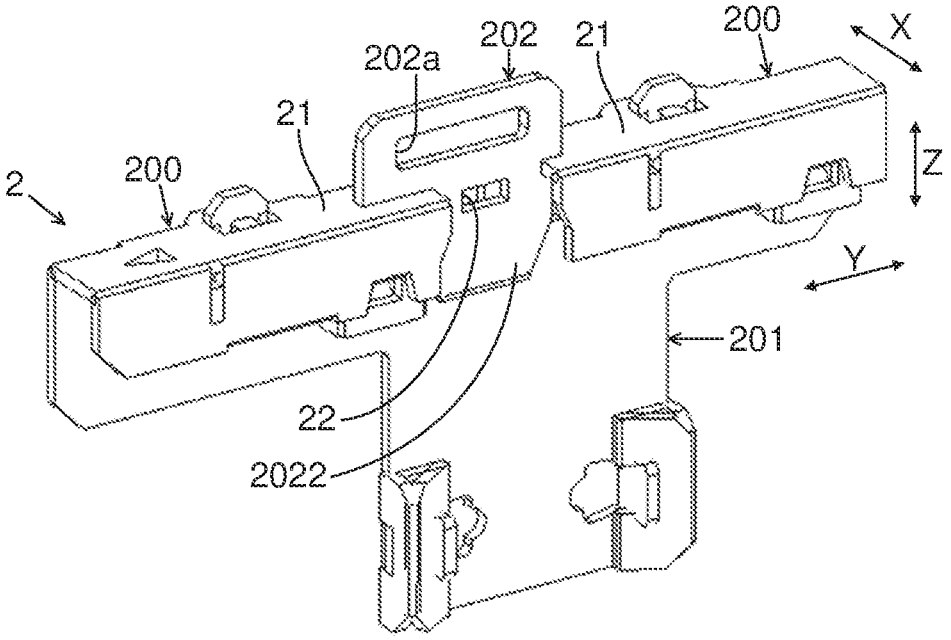
FIG. 5 is a perspective view when the second cushioning member in the embodiment is viewed from the right side.

Specifically, the first cushioning member 1 includes a first engagement portion 10 (see FIGS. 3 and 4). The second cushioning member 2 includes a second engagement portion 20 which can be engaged with the first engagement portion 10. The first engagement portion 10 is engaged with the second engagement portion 20, and thus the first cushioning member 1 and the second cushioning member 2 are coupled to each other.

The first cushioning member 1 includes, as the first engagement portion 10, a part which protrudes from the upper edge of the right side plate 101. In other words, the first engagement portion 10 is coupled to the upper edge of the right side plate 101. The first engagement portion 10 is bent at a part coupled to the right side plate 101. Hence, a crease is formed at a boundary between the right side plate 101 and the first engagement portion 10. The first engagement portion 10 can be turned such that an end portion on a side opposite to a side coupled to the right side plate 101 swings vertically with the part coupled to the right side plate 101 used as a fulcrum. The first engagement portion 10 can be inclined at least to the outward side (right side) in the left/right direction with the part coupled to the right side plate 101 used as the fulcrum.

The second cushioning member 2 includes, as the second engagement portion 20, a pair of end surfaces 210 of the pair of cushioning portions 200 which are spaced opposite each other in the forward/backward direction. Specifically, each of the pair of cushioning portions 200 includes a plate-shaped part 21. The pair of end surfaces 210 of the pair of plate-shaped parts 21 which are spaced opposite each other in the forward/backward direction serve as the second engagement portion. The pair of plate-shaped parts 21 are a pair of parts which form an upper surface portion of the square tube of the pair of cushioning portions 200. In the pair of plate-shaped parts 21, the up/down direction is the direction of the thickness thereof, and the pair of plate-shaped parts 21 are spaced opposite each other in the forward/backward direction. In the following description, the end surfaces 210 are referred to as engagement surfaces 210 so as to be distinguished from the other end surfaces.

In a state where the first engagement portion 10 and the second engagement portion 20 are engaged with each other, the pair of engagement surfaces 210 sandwich the first engagement portion 10 in the forward/backward direction. The width of at least a tip of the first engagement portion 10 on the side opposite to the side coupled to the right side plate 101 in the forward/backward direction is greater than a distance between the pair of engagement surfaces 210 in the forward/backward direction. In this way, the first engagement portion 10 is sandwiched between the pair of engagement surfaces 210 in the forward/backward direction, and thus the first engagement portion 10 and the second engagement portion 20 are engaged with each other.

Here, the first engagement portion 10 is bent over the upper edge of the base plate 201 with the part coupled to the right side plate 101 used as a starting point, and reaches an area between the pair of engagement surfaces 210 in the forward/backward direction. Then, the first engagement portion 10 is sandwiched between the pair of engagement surfaces 210 in the forward/backward direction. In this way, the first engagement portion 10 can be engaged with the second engagement portion 20.

Specifically, first, after an operation of storing the first cushioning member 1 in the packing case PB, an operation of storing the second cushioning member 2 in the packing case PB is performed. When the second cushioning member 2 is stored in the packing case PB, a state where the first engagement portion 10 is provided to stand upward is maintained (see FIG. 7). In this way, even when the first engagement portion 10 is provided in the first cushioning member 1, the first engagement portion 10 does not interfere with the storage of the second cushioning member 2.

In a state where the first cushioning member 1 and the second cushioning member 2 are stored in the packing case PB and the first engagement portion 10 is provided to stand upward, an operation of turning the first engagement portion 10 downward is performed. In other words, an operation of bending the first engagement portion 10 is performed. The first engagement portion 10 is bent to be sandwiched between the pair of engagement surfaces 210 in the forward/backward direction (see FIG. 8). Consequently, the first engagement portion 10 and the second engagement portion 20 are engaged with each other, and thus the second cushioning member 2 is coupled to the first cushioning member 1. In other words, the second cushioning member 2 is located with respect to the first cushioning member 1.

When the second cushioning member 2 coupled to the first cushioning member 1 is removed from the packing case PB, the engagement of the first engagement portion 10 and the second engagement portion 20 is preferably released. In the state where the first engagement portion 10 and the second engagement portion 20 are engaged with each other (see FIG. 8), the first engagement portion 10 is returned to the state where the first engagement portion 10 is provided to stand upward (see FIG. 7), and thus the engagement of the first engagement portion 10 and the second engagement portion 20 is released.

In the present embodiment, the first engagement portion 10 is provided in the first cushioning member 1, the first engagement portion 10 is engaged with the second engagement portion 20 of the second cushioning member 2 and thus it is possible to easily suppress a positional displacement of the second cushioning member 2.

For example, the second cushioning member 2 is enlarged in the forward/backward direction to make contact with the inner surfaces of the packing case PB on the front side and the back side, and thus it is possible to suppress a positional displacement of the second cushioning member 2. However, in this case, it is necessary to enlarge the second cushioning member 2, and thus the costs are increased.

On the other hand, in the present embodiment, even when the second cushioning member 2 is not caused to make contact with the inner surfaces of the packing case PB on the front side and the back side, the position of the second cushioning member 2 is not displaced. In this way, it is not necessary to increase the second cushioning member 2 in the forward/backward direction. In other words, in the present embodiment, in order to suppress a positional displacement of the second cushioning member 2, it is not necessary to increase the second cushioning member 2.

Furthermore, in the present embodiment, only by turning the first engagement portion 10 (in other words, only by inclining the first engagement portion 10 and causing the first engagement portion 10 to stand upward), the engagement of the first engagement portion 10 and the second engagement portion 20 can be achieved and released. In other words, in a state where the first cushioning member 1 and the second cushioning member 2 are stored in the packing case PB, the engagement of the first engagement portion 10 and the second engagement portion 20 can be achieved and released. Hence, it is possible to separately remove the first cushioning member 1 and the second cushioning member 2 from the packing case PB. Consequently, workability is satisfactory when the first cushioning member 1 and the second cushioning member 2 are removed from the packing case PB. In other words, an unpacking operation is easily performed.

In the present embodiment, the pair of engagement surfaces 210 are caused to function as the second engagement portion 20, and the width of at least the tip of the first engagement portion 10 on the side opposite to the side coupled to the right side plate 101 in the forward/backward direction is caused to be greater than the distance between the pair of engagement surfaces 210 in the forward/backward direction, with the result that it is possible to easily obtain the first engagement portion 10 and the second engagement portion 20 which can be engaged with each other.

In the present embodiment, the area between the pair of cushioning portions 200 in the forward/backward direction functions as the second engagement portion 20. Hence, it is not necessary to additionally provide a part which serves as the second engagement portion 20. In this way, it is possible to suppress complication of the second cushioning member 2.

In the present embodiment, the first engagement portion 10 is bent over the upper edge of the base plate 201 to be sandwiched between the pair of engagement surfaces 210 in the forward/backward direction, and thus the first engagement portion 10 and the second engagement portion 20 are engaged with each other. Hence, the first engagement portion 10 includes a hole 10*a* which penetrates in the direction of the thickness of the first engagement portion 10. The base plate 201 includes a projection 201*a* which protrudes upward from the upper edge of the base plate 201. In the state where the first engagement portion 10 and the second engagement portion 20 are engaged with each other, that is, in a state where the first engagement portion 10 is bent over the upper edge of the base plate 201, the projection 201*a* is inserted into the hole 10*a*. In this way, the engagement of the first engagement portion 10 and the second engagement portion 20 is enhanced.

<Release of Engagement of First Engagement Portion and Second Engagement Portion>

The first engagement portion 10 includes an engagement protrusion 11 which protrudes from the tip of the first engagement portion 10. The engagement protrusion 11 protrudes from the tip surface of the first engagement portion 10 in a direction orthogonal to the direction of the thickness of the first engagement portion 10. The second grasping portion 2022 includes an engagement hole 22 which penetrates in the direction of the thickness of the second grasping portion 2022. The engagement hole 22 has an opening shape into which the engagement protrusion 11 can be inserted.

In the state where the first engagement portion 10 and the second engagement portion 20 are engaged with each other, that is, in a state where the first engagement portion 10 is sandwiched between the pair of engagement surfaces 210 in the forward/backward direction, the engagement protrusion 11 protrudes to an outward side in the left/right direction. The engagement protrusion 11 is inserted into the engagement hole 22 from an inward side in the left/right direction. The width of the opening of the engagement hole 22 in the up/down direction is greater than the thickness of the engagement protrusion 11. In this way, the engagement protrusion 11 is easily inserted into and removed from the engagement hole 22.

In this configuration, as shown in FIGS. 9 to 11, the grasping plate 202 is pulled upward to be extended vertically such that the engagement of the first engagement portion 10 and the second engagement portion 20 is released. A specific description will be given below. In a state shown in FIG. 9, the first engagement portion 10 and the second engagement portion 20 are completely engaged with each other, and a schematic cross-sectional structure thereof is shown in the upper diagram of FIG. 12. In a state shown in FIG. 10, the grasping plate 202 starts to be pulled upward from the state shown in FIG. 9, and a schematic cross-sectional structure thereof is shown in the lower diagram of FIG. 12. In a state shown in FIG. 11, the grasping plate 202 is completed extended.

When in a state where the first engagement portion 10 and the second engagement portion 20 are completely engaged with each other, the grasping plate 202 is pulled upward to be extended, the position of the engagement hole 22 in the up/down direction with the engagement protrusion 11 inserted into the engagement hole 22 is displaced upward. Hence, as the grasping plate 202 is pulled upward, the engagement protrusion 11 is moved upward. In other words, the first engagement portion 10 is turned upward. In this way, the engagement of the first engagement portion 10 and the second engagement portion 20 is released. The engagement protrusion 11 is finally disconnected from the engagement hole 22.

In the present embodiment, the engagement hole 22 is provided in the grasping plate 202, the engagement protrusion 11 which can be inserted into the engagement hole 22 is provided in the first engagement portion 10, and thus the grasping plate 202 is only pulled upward in the state where the first engagement portion 10 and the second engagement portion 20 are completely engaged with each other, with the result that it is possible to release the engagement of the first engagement portion 10 and the second engagement portion 20. In other words, as the operation of removing the second cushioning member 2 from the packing case PB is performed, the engagement of the first engagement portion 10 and the second engagement portion 20 is released. In this way, it is not necessary to separately perform an operation of releasing the engagement of the first engagement portion 10 and the second engagement portion 20, and thus workability when the item to be packed PA is unpacked is enhanced.

<Fixing of Grasping Plate>

The grasping plate 202 is sandwiched between the pair of cushioning portions 200 in the forward/backward direction. Specifically, the grasping plate 202 is sandwiched between the pair of plate-shaped parts 21 in the forward/backward direction. The pair of plate-shaped parts 21 sandwich the second grasping portion 2022 of the grasping plate 202 in the forward/backward direction.

Here, when the pair of plate-shaped parts 21 sandwich only the second grasping portion 2022 in the forward/backward direction, the grasping plate 202 may be moved upward unintentionally. When the grasping plate 202 is moved upward, the engagement of the first engagement portion 10 and the second engagement portion 20 is released, and this causes a positional displacement of the second cushioning member 2.

Hence, as shown in FIG. 13, the second grasping portion 2022 includes a pair of locking pieces 23 which protrude outward in the forward/backward direction from both ends of the second grasping portion 202 in the forward/backward direction. In the state where the first engagement portion 10 and the second engagement portion 20 are engaged with each other, the pair of locking pieces 23 are located below the pair of plate-shaped parts 21. The pair of locking pieces 23 are in contact with the lower surfaces of the plate-shaped parts 21 on the respective sides. In other words, the second grasping portion 2022 is in contact with the lower surfaces of the pair of plate-shaped parts 21.

In the present embodiment, in the state where the first engagement portion 10 and the second engagement portion 20 are engaged with each other, the second grasping portion 2022 is in contact with the lower surfaces of the pair of plate-shaped parts 21, and thus it is possible to suppress unintentional upward movement of the grasping plate 202. In other words, it is possible to suppress unintentional release of the engagement of the first engagement portion 10 and the second engagement portion 20. Consequently, it is possible to suppress a positional displacement of the second cushioning member 2.

The embodiment disclosed here should be considered in all respects illustrative and not restrictive. The scope of the present disclosure is indicated not by the description of the above embodiment but by the scope of claims, and meanings equivalent to the scope of claims and all changes within the scope are further included therein.

What is claimed is:

1. A packing member comprising:

a packing case that includes an opening in an upper portion and that an item to be packed is removed from and inserted into via the opening;

a first cushioning member that includes a side plate which is arranged opposite the item to be packed in a first direction; and a second cushioning member that is arranged between the side plate and the packing case, wherein the first cushioning member includes a first engagement portion, the first engagement portion is coupled to an upper edge of the side plate and is bent at a part coupled to the side plate such that a tip on a side opposite to a side coupled to the side plate can be turned vertically with the coupled part used as a fulcrum, the second cushioning member includes a second engagement portion that can be engaged with the first engagement portion, the first cushioning member and the second cushioning member are stored in the packing case, and the first engagement portion and the second engagement portion are engaged with each other by turning the first engagement portion downward such that the first cushioning member is located with respect to the second cushioning member and the first engagement portion is turned upward in a state where the first engagement portion and the second engagement portion are engaged with each other such that the engagement of the first engagement portion and the second engagement portion is released.

2. The packing member according to claim 1, wherein the second cushioning member includes a base plate that is arranged opposite the side plate in the first direction and a pair of cushioning portions that are coupled to an upper edge of the base plate and are bent into a square tube shape on an outward side relative to the base plate in the first direction, the pair of cushioning portions are spaced opposite each other in a second direction orthogonal to the first direction, the second cushioning member includes, as the second engagement portion, a pair of end surfaces of the pair of cushioning portions that are spaced opposite each other in the second direction and the first engagement portion is bent over the upper edge of the base plate and is sandwiched between the pair of end surfaces in the second direction such that the first engagement portion and the second engagement portion are engaged with each other.

3. The packing member according to claim 2, wherein a width of at least the tip of the first engagement portion in the second direction is greater than a distance between the pair of end surfaces in the second direction.

4. The packing member according to claim 2, wherein the first engagement portion includes a hole that penetrates in a direction of a thickness of the first engagement portion, the base plate includes a projection that protrudes upward from the upper edge of the base plate and in the state where the first engagement portion and the second engagement portion are engaged with each other, the projection is inserted into the hole.

5. The packing member according to claim 2, wherein the second cushioning member includes a grasping plate that is coupled to the upper edge of the base plate, the grasping plate includes a first grasping portion that is bent downward from the upper edge of the base plate and a second grasping portion that is bent upward from an edge of the first grasping portion on a side opposite to a side coupled to the base plate and is arranged on an outward side relative to the first grasping portion in the first direction, the first engagement portion includes an engagement protrusion that protrudes from the tip, the second grasping portion includes an engagement hole that penetrates in a direction of a thickness of the second grasping portion, in the state where the first engagement portion and the second engagement portion are engaged with each other, the engagement protrusion is inserted into the engagement hole from an inward side in the first direction and in the state where the first engagement portion and the second engagement portion are engaged with each other, the grasping plate is pulled upward to be extended such that a position of the engagement hole in an up/down direction with the engagement protrusion inserted into the engagement hole is displaced upward, and thus the first engagement portion is turned upward to release the engagement of the first engagement portion and the second engagement portion.

6. The packing member according to claim 5, wherein each of the pair of cushioning portions includes a plate-shaped part in which the up/down direction is a direction of a thickness of the plate-shaped part, the pair of plate-shaped parts sandwich the second grasping portion in the second direction, the second grasping portion includes a pair of locking pieces that protrude outward in the second direction from both ends of the second grasping portion in the second direction and in the state where the first engagement portion and the second engagement portion are engaged with each other, the pair of locking pieces are in contact with lower surfaces of the pair of plate-shaped parts.

* * * * *